United States Patent [19]

Cimino

[11] Patent Number: 4,919,452

[45] Date of Patent: Apr. 24, 1990

[54] SKI LOCATOR DEVICE UTILIZING A FOAM BALL

[75] Inventor: John J. Cimino, 408 Ridge Ave., #21-2, Evanston, Ill. 60202

[73] Assignee: John J. Cimino, Evanston, Ill.

[21] Appl. No.: 299,320

[22] Filed: Mar. 23, 1989

[51] Int. Cl.[5] ..... A63C 11/00

[52] U.S. Cl. ..... 280/809; 280/637; 116/209

[58] Field of Search ..... 280/637, 809, 811; 116/209, 210, DIG. 8, DIG. 9; 441/6, 7, 9, 23, 30, 68, 75

[56] References Cited

U.S. PATENT DOCUMENTS

| | | | |
|---|---|---|---|
| 736,692 | 8/1903 | Condren | 441/6 |
| 1,025,497 | 5/1912 | Wensley | 441/6 |
| 3,171,128 | 2/1965 | Shattuck | 116/DIG. 9 X |
| 3,225,368 | 12/1965 | Allen | 441/7 |
| 3,407,418 | 10/1978 | May et al. | 441/9 |

FOREIGN PATENT DOCUMENTS

| | | | |
|---|---|---|---|
| 2378533 | 9/1978 | France | 280/637 |
| 0607926 | 12/1978 | Switzerland | 116/210 |

*Primary Examiner*—Charles A. Marmor
*Assistant Examiner*—Brian L. Johnson

[57] ABSTRACT

A ski locator device is provided which comprises a tether having one end attached to the ski and the other attached to a brightly-colored foam ball. The foam ball is compacted and inserted into a zippered pouch which is attached either to the skier's leg or to his boot. Upon detachment of the ski from the skier's foot, the foam ball is pulled through the aperture in the pouch and can be readily seen, thereby assisting in locating the ski.

5 Claims, 1 Drawing Sheet

SKI LOCATOR DEVICE UTILIZING A FOAM BALL

BACKGROUND OF THE INVENTION

1. Field of the Invention

The present invention relates to a device for locating a detached ski in deep powder.

2. Background Art

The modern ski binding is attached to the ski and is designed to release the skier's boot from the ski so as to prevent bodily injury to the skier. Unfortunately, when skiing in deep powdered snow, the ski is frequently lost because it will remain below the surface of the snow. Thus, the skier will have to dig in the snow, frequently exhausting himself in adverse weather conditions which may lead to health problems such as frost bite. Quite often, he will never find the ski because it was thrown too far from him, and, beside losing hundreds of dollars worth of ski equipment, he will have to walk down the mountain in deep snow and, thus, again expose himself to health hazards from fatigue or adverse weather conditions. This invention is designed to enable the skier to locate his ski quickly while still allowing the ski to completely detach from the skier's boot and thus prevent bodily harm.

Various devices have been designed to prevent the skier from losing his ski in deep powder. Patents of interest in this field, or in locating lost objects in general, include the following:

U.S. Pat. No. 4,535,322 issued Aug. 13, 1985, to Yeski discloses a ski alarm and locator that sounds an alarm when the ski becomes detached from the boot. The system relies on sound rather than sight. It requires complex electrical circuitry and a power source which would be much more expensive and may become faulty, unbeknownst to the skier. It does not offer the simple, straight-forward, and inexpensive means that my invention offers.

U.S. Pat. No. 4,685,697 issued Aug. 11, 1987, to Thorley discloses a retractable ski leash device. The leash is attached to the skier's boot on one end and is wound around a spool in a housing attached to the ski on the other end. This device does not permit complete detachment of the ski from the skier's boot, as does my invention, and thus may lead to serious bodily injury in a more serious ski accident, hurting either the skier wearing the device or an innocent bystander. Furthermore, the housing embodying the spool to which the tether is attached may become faulty in icy conditions or simply from wear and tear.

U.S. Pat. No. 4,063,753 issued Dec. 20, 1977 to Cordeiro discloses a runaway binding device which causes the ski to remain attached to the skier's ankle by means of a long tether after a fall. The device would be dangerous both to the skier and to innocent bystanders because the tether would pull the ski along with the skier during a serious accident.

U.S. Pat. No. 3,945,338 issued Mar. 23, 1976 to Correa discloses an inflatable balloon for locating lost aircraft.

U.S. Pat. No. 4,013,035 issued Mar. 22, 1976 discloses a balloon signal assembly embodying a means of automatically filling a balloon with a lighter than air gas for signalling purposes. This is not designed for snow skiing and would not apply here.

U.S. Pat. No. 3,764,154 discloses a safety ski binding which includes a rigid base plate member disposable between a sole member of a ski boot and a ski member. This would not provide for ski location after a fall.

U.S. Pat. No. 3,893,682 discloses a releasable ski binding having a self-restoring capability. This does not provide a means for locating a ski after a fall.

U.S. Pat. No. 4,203,614 discloses a ski binding employing a cable connected at one end to the skiing boot and at the other end to the ski. This does not permit for complete detachment of the ski from the skier.

German Patent No. 24 06 754 discloses a retractable line tethering a ski to a skier's boot. This does not provide for complete detachment of the ski from the skier.

German Patent No. 27 06 015 discloses a ski recovery device consisting of a belt which is attached to the ski boot or user at one end and fixed to the ski at the other end. This does not provide for complete detachment of the ski from the skier.

German Patent No. 26 24 501 discloses a strap having one end fastened to the heel housing of the ski boot via a coil spring. A snap hook on the other end is attached to an eye on the ski or ski bonding. This does not provide for complete detachment of the ski from the skier.

German Patent No. 29 30 502 discloses a rotatable spool fitted on the upper surface of the ski which carries a connecting line attached to the skier. The connecting line is made from a phosphorescent material and employs an optical or acoustic warning installation on the ski and coordinated with the moving of the spool.

SUMMARY OF THE INVENTION

In accordance with the invention, a ski locating device utilizing an expandable signal element, preferably a foam ball, is provided to enable a snow skier to locate his ski in deep powder snow after it has been completely detached from his boot. The fact that the ski becomes completely detached from the skier is critical to safety because if the ski is left dangling from the skier's boot or angle by means of a tether, it will cause the ski to injure the skier or an innocent bystander.

It is the object of this invention to enable the ski to be completely detached from the skier yet enabling the skier to easily find his ski, particularly in deep powder. This is done by means of the foam ball which is attached to the ski by means of a tether and which is brightly colored and large enough that it will remain above the level of the snow even after the ski is buried beneath the level of the snow. Because the ski is completely detached from the skier, it will not cause bodily injury. Furthermore, the skier can now more easily erect himself after falling because he is not tied to the ski by the tether.

While skiing, the foam ball is kept out of the way of the skier by being compressed neatly into a zipper pouch which is attached to the skier's boot or to his ankle. There is an aperture in the distal end of the pouch which is just large enough to enable the foam ball to exit the pouch when the ski becomes detached from the skier during a fall.

BRIEF DESCRIPTION OF THE DRAWINGS

This invention can be more readily understood by referring to the accompanying drawings, wherein.

DETAILED DESCRIPTION OF A PREFERRED EMBODIMENT

Figure 1:
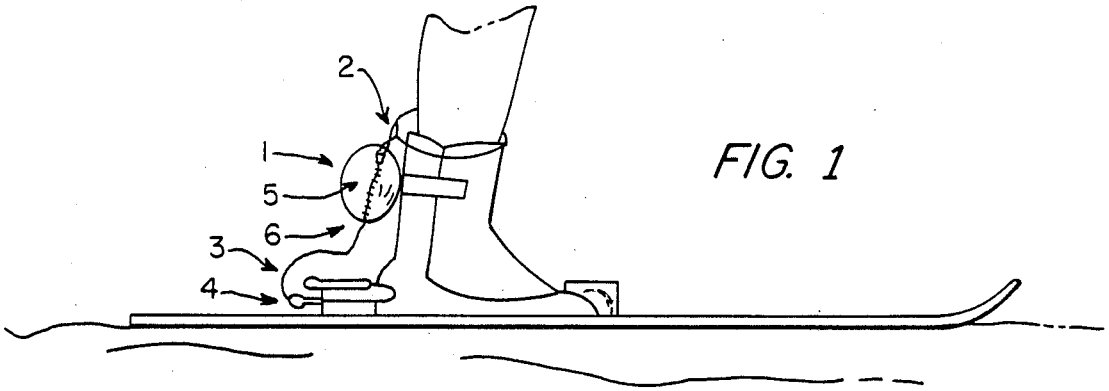
FIG. 1 shows what the ski locator device looks like while the skier is skiing. The foam ball is neatly compressed into the zippered pouch.
Figure 2:
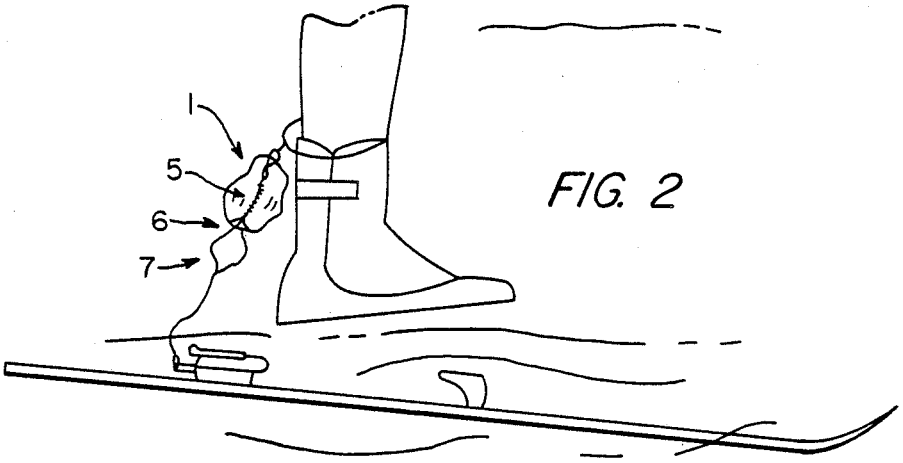
FIG. 2 shows the foam ball beginning to be pulled through the distal aperture of the zippered pouch as the skier's boot becomes detached from the binding on the ski during a fall.
Figure 3:
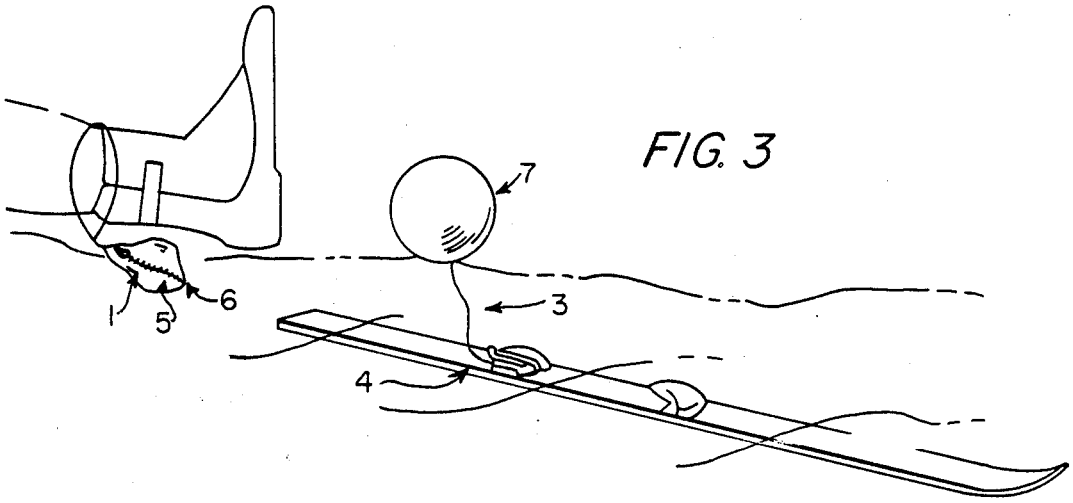
FIG. 3 shows the foam ball now completely pulled out of the zippered pouch. the skier has fallen, and the zippered pouch remains attached to the skier. The foam ball remains with the ski and is attached to it via a tether. Although the ski is buried beneath the snow, the brightly colored foam ball remains above the level of the snow.

FIG. 1 shows the zippered pouch (1) completely enclosing a compressible signal element comprising a foam ball which is not shown in FIG. 1 but is denoted (7) in FIGS. 2 and 3. A zipper (5) is closed. The pouch (1) is attached by a tether (2) to the skier's ankle. This may be substituted for a clip which attaches over the top edge of the skier's boot. The tether (3) which is attached to the foam ball (now shown) is seen as it exits from a distal aperture (6) of the pouch (5). This tether (3) is attached to the skier's binding by a ring (4). This may be changed in a fashion that allows the tether (3) to be instead attached to the ski itself.

FIG. 2 shows the foam ball (7) as it begins to exit the distal aperture (6) of the pouch (1). The zipper (5) remains closed. As illustrated, the skier's boot is released from the binding of the ski during the fall.

FIG. 3 shows the foam ball (7), now completely free from the zipper pouch and remaining above the level of the snow while the ski is below the level of the snow (indicated in chain lines). The tether (3) keeps the foam ball (7) attached to the ski by the ring (4). The zippered pouch (1) remains with the zipper (5) closed. The foam ball (7) has exited from the zippered pouch (1) with the zipper (5) remaining closed. The foam ball (7) has exited from the zippered pouch (1) via the distal aperture (6).

Figure 4:
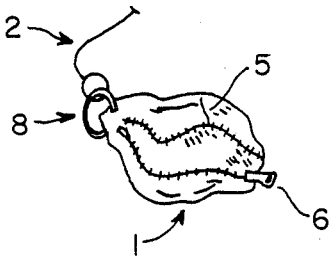
FIG. 4 shows a more detailed drawing of the zippered pouch with the zipper now opened so that the foam ball can once again be neatly compressed into the pouch. The zipper would then be closed, and the tether attached to the foam ball would hang out of the pouch via the distal aperture so that it can again pull the foam ball out when necessary.

FIG. 4 shows the zippered pouch (1) with the zipper (5) now opened to enable re-fitting the foam ball (7) into the pouch. There is a ring (8) on the proximal end of the pouch to enable the tether (2) to attach to the pouch. This tether (2) then attaches to the skier's ankle as described above. The pouch may be made from a variety of material such as vinyl or leather.

I claim:

1. A device for locating a ski after the ski has become separated from a skier wearing the ski, said device comprising:
   - a normally closed, openable pouch, including an exit opening therein and means for attaching the pouch to a skier;
   - a compressible signal element confined in a compressed state within said pouch and expandable to an expanded state upon release thereof from said pouch through said exit opening in said pouch; and
   - tether means, having a first end, which extends through said exit opening in said pouch and is attached to said signal element and a second end which is disposed outside of said pouch and which includes means for attaching the second end of the tether means to a ski worn by the skier, for, when the ski is separated from the skier, pulling the signal element out of said pouch through said exit opening so as to permit said signal element to expand to the expanded state thereof and thereby indicate the location of the ski.

2. A device for locating a ski according to claim 1 wherein said signal element comprises a brightly colored foam ball.

3. A device for locating a ski according to claim 1 wherein said pouch includes an openable closure means thereon for permitting, when opened, the signal element to be inserted into the pouch and enclosed therein by closing said openable closure means.

4. A device for locating a ski according to claim 3 wherein said exit opening is located at one end of said openable closure means.

5. A device for locating a ski according to claim 1 wherein said means for attaching the pouch to a skier comprises a ring.

* * * * *